US006663203B1

(12) United States Patent
Miller, Jr.

(10) Patent No.: US 6,663,203 B1
(45) Date of Patent: Dec. 16, 2003

(54) COMPUTER DESK

(76) Inventor: Charles M. Miller, Jr., 1202 Fargo Trail, Greensboro, NC (US) 27406

( * ) Notice: Subject to any disclaimer, the term of this patent is extended or adjusted under 35 U.S.C. 154(b) by 0 days.

(21) Appl. No.: 10/158,959

(22) Filed: May 31, 2002

(65) Prior Publication Data

(65)

(51) Int. Cl.[7] ..... A47B 47/00
(52) U.S. Cl. ..... 312/258
(58) Field of Search ..... 312/258, 259, 312/262, 108, 111; 108/11, 38, 41

(56) References Cited

U.S. PATENT DOCUMENTS 4,579,401 A * 4/1986 Mears ..... 312/258
5,083,512 A * 1/1992 Newhouse et al. ..... 108/50.02
5,558,418 A * 9/1996 Lambright et al. ..... 312/321.5
5,697,686 A * 12/1997 Miller et al. ..... 312/194
5,779,366 A * 7/1998 McKenzie et al. ..... 383/22
6,158,831 A * 12/2000 Brown et al. ..... 312/358
6,315,308 B1 * 11/2001 Konopka ..... 280/47.35
6,431,091 B1 * 8/2002 Chang ..... 108/115

* cited by examiner

*Primary Examiner*—Leslie A. Braun
*Assistant Examiner*—A. Joseph Wujciak, III

(57) ABSTRACT

A computer desk includes a plurality of shelves that is coupled to at least one of a pair of stanchion members. Each of the shelves is hingably coupled to at least one of the stanchion members for facilitating folding of the shelves into a storage position. Each of the shelves is for supporting objects when the shelves are in an extended position. Each of the stanchion members has a slide rail. A sliding shelf is slidably coupled to the slide rail of each of the stanchion members such that the sliding shelf is slidably adjustable with respect to the stanchion members of the frame assembly. The sliding shelf is for supporting a keyboard of the computer system. The sliding shelf is removable from between the stanchion members when the shelves are folded into the storage position.

19 Claims, 4 Drawing Sheets

COMPUTER DESK

BACKGROUND OF THE INVENTION

1. Field of the Invention

The present invention relates to computer desks and more particularly pertains to a new computer desk for providing a user with ample storage space while in use, yet take up very little room when folded for storage.

2. Description of the Prior Art

The use of computer desks is known in the prior art. More specifically, computer desks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,403,082; U.S. Pat. No. 5,769,514; U.S. Pat. No. 6,036,289; U.S. Pat. No. Des. 426,085; U.S. Pat. No. 6,039,419; and U.S. Pat. No. 5,882,098.

While these devices fulfill their respective, particular objectives and requirements, the aforementioned patents do not disclose a new computer desk. The inventive device includes a plurality of shelves that is coupled to at least one of a pair of stanchion members. Each of the shelves is hingably coupled to at least one of the stanchion members for facilitating folding of the shelves into a storage position. Each of the shelves is adapted for supporting objects when the shelves are in an extended position. Each of the stanchion members has a slide rail. A sliding shelf is slidably coupled to the slide rail of each of the stanchion members such that the sliding shelf is slidably adjustable with respect to the stanchion members of the frame assembly. The sliding shelf is adapted for supporting a keyboard of the computer system. The sliding shelf is removable from between the stanchion members when the shelves are folded into the storage position.

In these respects, the computer desk according to the present invention substantially departs from the conventional concepts and designs of the prior art, and in so doing provides an apparatus primarily developed for the purpose of providing a user with ample storage space while in use, yet take up very little room when folded for storage.

SUMMARY OF THE INVENTION

In view of the foregoing disadvantages inherent in the known types of computer desks now present in the prior art, the present invention provides a new computer desk construction wherein the same can be utilized for providing a user with ample storage space while in use, yet take up very little room when folded for storage.

The general purpose of the present invention, which will be described subsequently in greater detail, is to provide a new computer desk apparatus and method which has many of the advantages of the computer desks mentioned heretofore and many novel features that result in a new computer desk which is not anticipated, rendered obvious, suggested, or even implied by any of the prior art computer desks, either alone or in any combination thereof.

To attain this, the present invention generally comprises a plurality of shelves that is coupled to at least one of a pair of stanchion members. Each of the shelves is hingably coupled to at least one of the stanchion members for facilitating folding of the shelves into a storage position.

Each of the shelves is adapted for supporting objects when the shelves are in an extended position. Each of the stanchion members has a slide rail. A sliding shelf is slidably coupled to the slide rail of each of the stanchion members such that the sliding shelf is slidably adjustable with respect to the stanchion members of the frame assembly. The sliding shelf is adapted for supporting a keyboard of the computer system. The sliding shelf is removable from between the stanchion members when the shelves are folded into the storage position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new computer desk apparatus and method which has many of the advantages of the computer desks mentioned heretofore and many novel features that result in a new computer desk which is not anticipated, rendered obvious, suggested, or even implied by any of the prior art computer desks, either alone or in any combination thereof.

It is another object of the present invention to provide a new computer desk, which may be easily and efficiently manufactured and marketed.

It is a further object of the present invention to provide a new computer desk, which is of a durable and reliable construction.

An even further object of the present invention is to provide a new computer desk which is susceptible of a low cost of manufacture with regard to both materials and labor, and which accordingly is then susceptible of low prices of sale to the consuming public, thereby making such computer desk economically available to the buying public.

Still yet another object of the present invention is to provide a new computer desk, which provides in the apparatuses and methods of the prior art some of the advantages thereof, while simultaneously overcoming some of the disadvantages normally associated therewith.

Still another object of the present invention is to provide a new computer desk for providing a user with ample storage space while in use, yet take up very little room when folded for storage.

Yet another object of the present invention is to provide a new computer desk, which includes a plurality of shelves that is coupled to at least one of a pair of stanchion members. Each of the shelves is hingably coupled to at least one of the stanchion members for facilitating folding of the shelves into a storage position. Each of the shelves is adapted for supporting objects when the shelves are in an extended position. Each of the stanchion members has a slide rail. A sliding shelf is slidably coupled to the slide rail of each of the stanchion members such that the sliding shelf is slidably adjustable with respect to the stanchion members of the frame assembly. The sliding shelf is adapted for supporting a keyboard of the computer system. The sliding shelf is removable from between the stanchion members when the shelves are folded into the storage position.

Still yet another object of the present invention is to provide a new computer desk that would provide all the conveniences of a full-size computer desk to individuals who may not have room for a standard desk and chair.

Even still another object of the present invention is to provide a new computer desk that would store quickly and compactly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
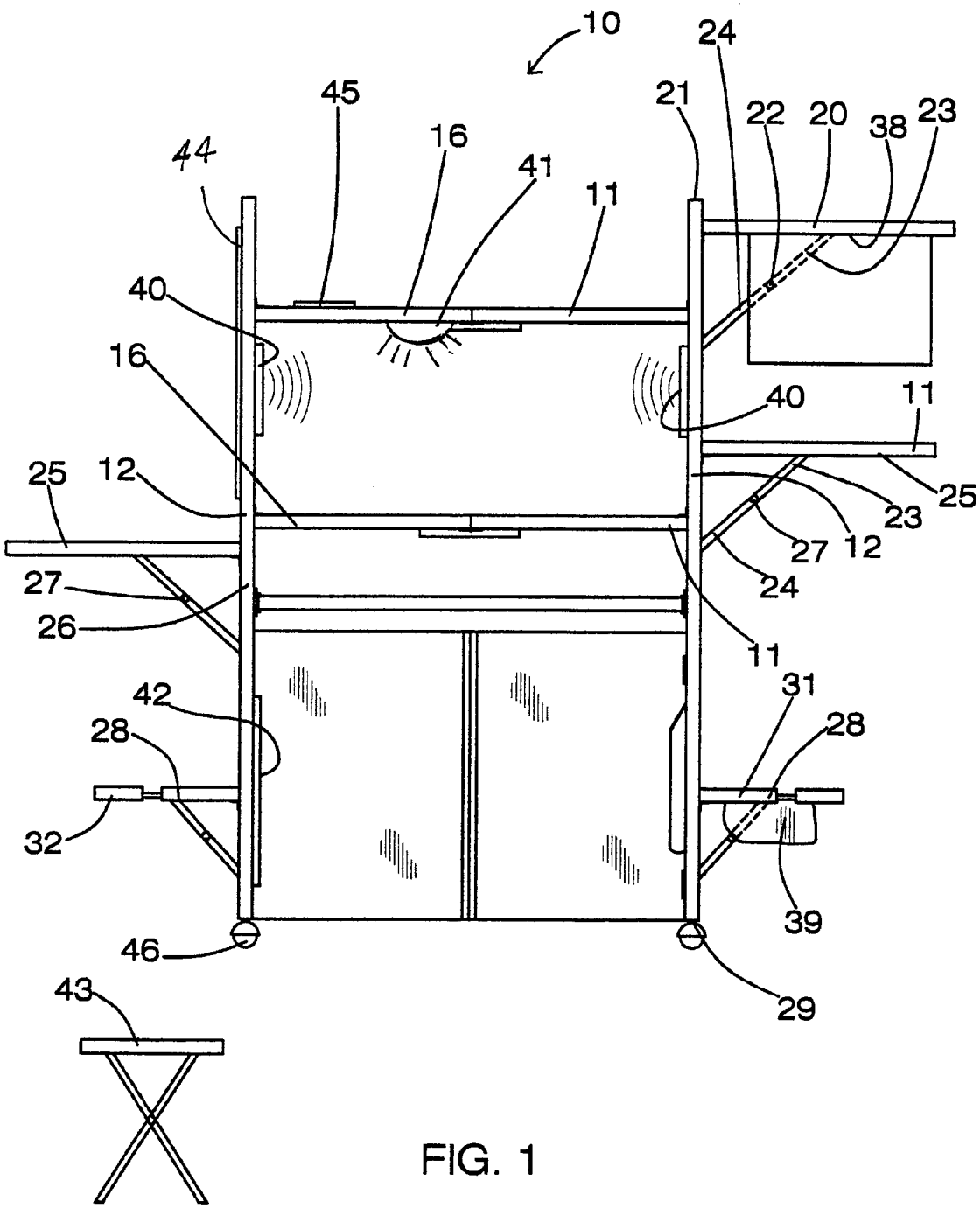
FIG. 1 is a front view of a new computer desk according to the present invention.
Figure 2:
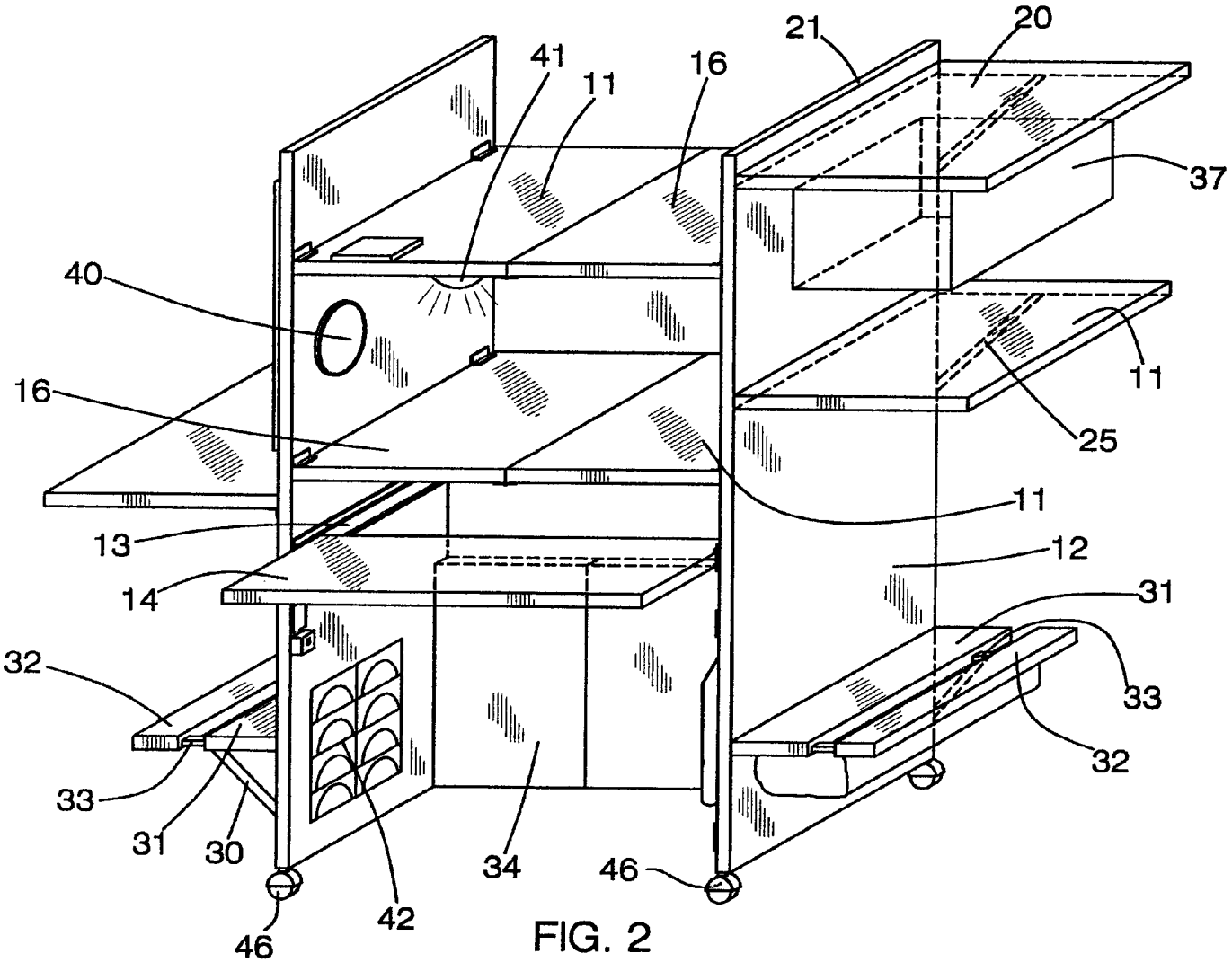
FIG. 2 is a perspective view of the present invention.
Figure 3:
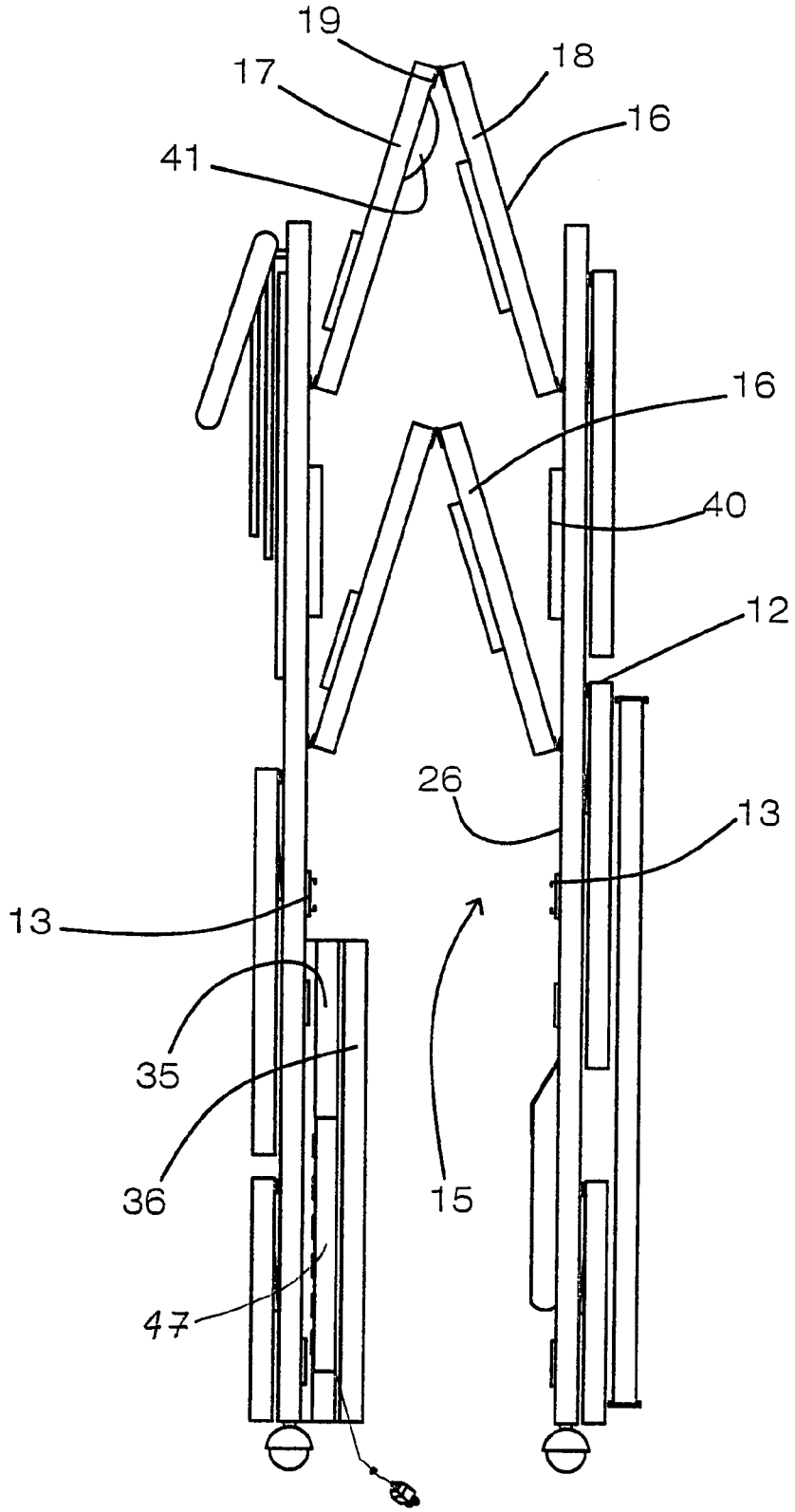
FIG. 3 is a side view of the present invention.
Figure 4:
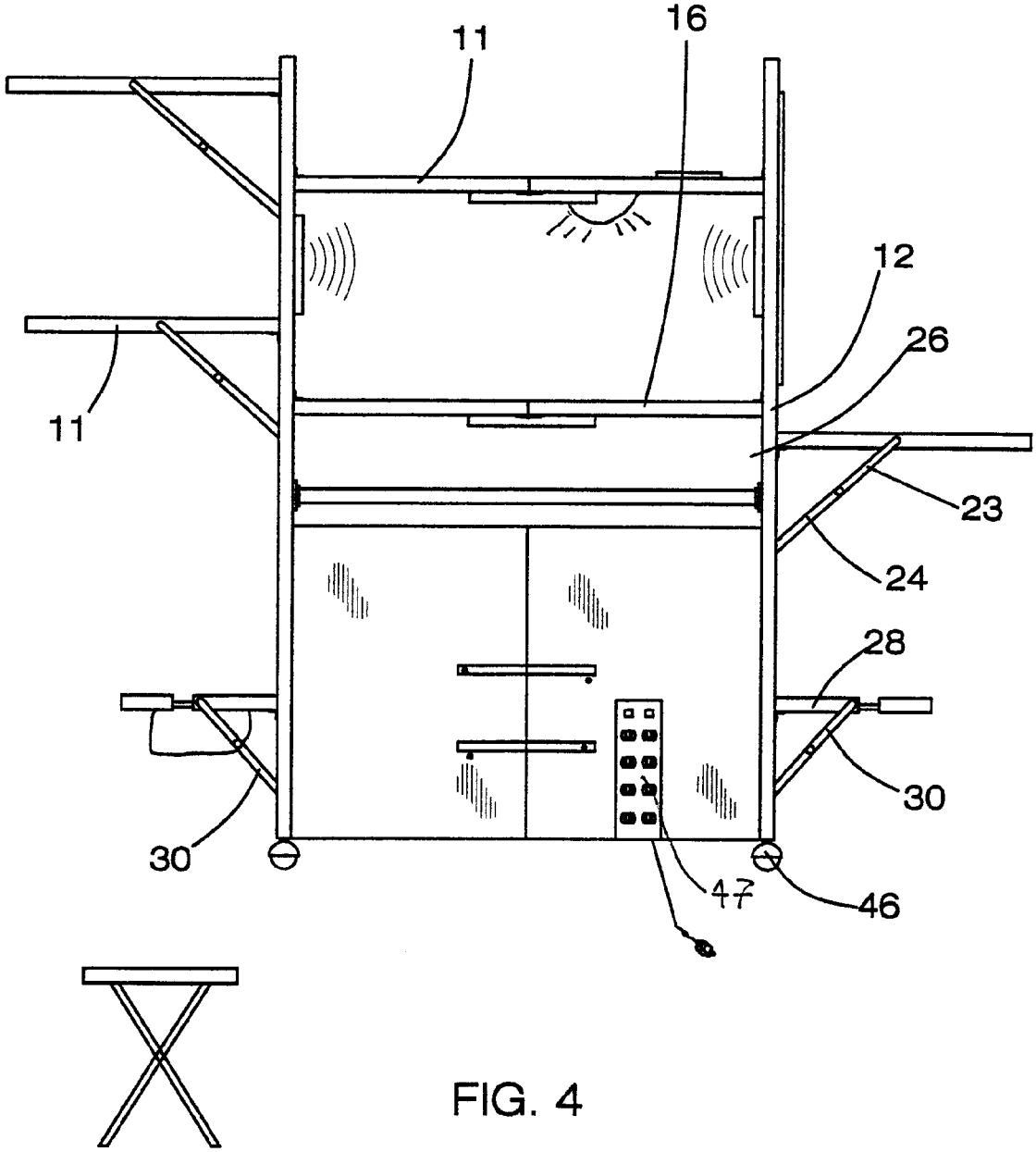
FIG. 4 is a front view of the present invention.

With reference now to the drawings, and in particular to FIGS. 1 through 4 thereof, a new computer desk embodying the principles and concepts of the present invention and generally designated by the reference numeral 10 will be described.

As best illustrated in FIGS. 1 through 4, the computer desk 10 generally includes a plurality of shelves 11 that is coupled to at least one of a pair of stanchion members 12. Each of the shelves 11 is hingably coupled to at least one of the stanchion members 12 for facilitating folding of the shelves 11 into a storage position. Each of the shelves 11 is adapted for supporting objects when the shelves 11 are in an extended position. Each of the stanchion members 12 has a slide rail 13. A sliding shelf 14 is slidably coupled to the slide rail 13 of each of the stanchion members 12 such that the sliding shelf 14 is slidably adjustable with respect to the stanchion members 12 of the frame assembly 15. The sliding shelf 14 is adapted for supporting a keyboard of the computer system. The sliding shelf 14 is removable from between the stanchion members 12 when the shelves 11 are folded into the storage position.

The shelves 11 comprise a pair of component shelves 16. Each of the component shelves 16 is coupled between the stanchion members 12. Each of the component shelves 16 is adapted for supporting a component of the computer system.

Each of the component shelves 16 has a first portion 17 and a second portion 18. The first portion 17 of each of the components is hingably coupled to one of the stanchion members 12. The second portion 18 of each of the component shelves 16 are hingably coupled to one of the stanchion members 12 opposite the first portion 17 an associated one of the component shelves 16. The first portion 17 of one of the component shelves 16 is hingably coupled to the second portion 18 of the associated one of the component shelves 16 for permitting the component shelves 16 to fold when the shelves 11 are folded into a storage position.

Each of the component shelves 16 has bracing arm 19. The bracing arm 19 of each of the component shelves 16 is pivotally coupled to the second portion 18 of the component shelves 16. The bracing arm 19 is positionable under the first portion 17 and an associated the second portion 18 of the component shelves 16 for securing each of the component shelves 16 in an extended position.

The plurality of shelves 11 comprising at least one top shelf 20. The top shelf 20 is hingably coupled proximate a top end 21 of one of the stanchion members 12. The top shelf 20 is adapted for supporting objects when the shelves 11 are in the extended position.

A top bracket member 22 has a first arm 23 and a second arm 24. The first arm 23 of the top bracket member 22 is rotatably coupled to the top shelf 20. The second arm 24 of the top bracket member 22 is rotatably coupled to the stanchion member 12 adjacent the top shelf 20. The first arm 23 of the top bracket member 22 is rotatably coupled to the second arm 24 of the top bracket member 22 for permitting the top bracket member 22 to fold when the shelves 11 are in the storage position. The top bracket member 22 is for supporting the top shelf 20 when the shelves 11 are in the extended position.

The plurality of shelves 11 comprising a pair of medial a shelves 25. Each of the medial shelves 25 is hingably coupled proximate a medial portion 26 of one of the stanchion members 12. Each of the medial shelves 25 is adapted for supporting objects when the shelves 11 are in the extended position.

A plurality of medial bracket members 27 each has a first arm 23 and a second arm 24. Each of the medial bracket members 27 is coupled to one of the medial shelves 25. The first arm 23 of one of the medial bracket members 27 is rotatably coupled to one of the medial shelves 25. The second arm 24 of one of the medial bracket members 27 is rotatably coupled to the stanchion member 12 adjacent an associated one of the medial shelves 25. The first arm 23 of the medial bracket member 27 is rotatably coupled to an associated the second arm 24 of one of the medial bracket members 27 of the associated one of the medial shelves 25 for permitting the medial bracket members 27 to fold when the shelves 11 are in the storage position. The medial bracket members 27 are for supporting the associated one of the medial shelves 25 when the shelves 11 are in the extended position.

The plurality of shelves 11 comprising a pair of bottom shelves 28. Each of the bottom shelves 28 is hingably coupled proximate a bottom end 29 of one of the stanchion members 12. Each of the bottom shelves 28 is adapted for supporting objects when the shelves 11 are in the extended position.

A plurality of bottom bracket members 30 each has a first arm 23 and a second arm 24. Each of the bottom bracket members 30 is coupled to one of the bottom shelves 28. The first arm 23 of one of the bottom bracket members 30 is rotatably coupled to one of the bottom shelves 28. The second arm 24 of one of the bottom bracket members 30 is rotatably coupled to the stanchion member 12 adjacent an associated one of the bottom shelves 28. The first arm 23 of the bottom bracket member 30 is rotatably coupled to an associated the second arm 24 of one of the bottom bracket members 30 of the associated one of the bottom shelves 28 for permitting the bottom bracket members 30 to fold when the shelves 11 are in the storage position, the bottom bracket members 30 is for supporting the associated one of the bottom shelves 28 when the shelves 11 are in the extended position.

Each of the bottom shelves 28 has a base portion 31 and an extension portion 32. The base portion 31 of each of the bottom shelves 28 is hingably coupled to one of the stanchions 12. The extension portion 32 of each of the bottom shelves 28 is slidably coupled to the base portion 31 of an associated one of the bottom shelves 28 such that the extension portion 32 is extended from the base portion 31 of the associated one of the bottom shelves 28 when the bottom shelves 28 are supporting a wide object.

The extension portion 32 of each of the bottom shelves 28 has a plurality of rods 33. Each of the rods 33 is slidably received by the base portion 31 of the associated one of the bottom shelves 28 for facilitating adjustment of the extension portion 32 with respect to the base portion 31 of the associated one of the bottom shelves 28.

A bracing member 34 is extended between the stanchion members 12. The bracing member 34 is for securing the stanchion members 12 when the shelves 11 are in an extended position. The bracing member 34 has a first bracing portion 35 and second bracing portion 36. The first bracing portion 35 is hingably coupled to one of the stanchion members 12. The second bracing portion 36 is hingably coupled to one of the stanchion members 12 opposites the first bracing portion 35. The first bracing portion 35 is hingably coupled to the second bracing portion 36 for facilitating folding of the bracing member 34 when the shelves 11 are folded into the storage position.

A storage bin 37 is coupled to a bottom surface 38 of the top shelf 20. The storage bin 37 is collapsible when the shelves 11 are folded into the storage position. The storage bin 37 is adapted for storing objects under the top shelf 20.

A bag member 39 is coupled to a lower surface of one of the bottom shelves 28. The bag member 39 is adapted for holding tools within the bag member 39.

A plurality of speakers 40 each is coupled to one of the stanchion members 12. Each of the speakers 40 is adapted for operationally coupling to the computer system for producing sound generated by the computer system.

A light assembly 41 is coupled to one of the component shelves 16. The light assembly 41 is adapted for emitting light onto objects is supported on another of the shelves 11 when the user requires additional light.

At least one media storage device 42 is coupled to one of the stanchion members 12. The media storage device 42 is adapted for storing media when the media is not is used by the user.

In and embodiment the present invention would include a folding chair 43. At least one note board 44 coupled to one of the stanchion members 12. At least one fold up mirror 45 coupled to a top shelf, and at least one paper folder coupled to a bottom of one of the stanchion members. A surge protector 47 would be located on the bracing member 34. The bottom end 29 of the stanchion members 12 would also have casters 46 such that the unit could be easily slid across a supporting surface.

In use, the user would use the present invention similar to a standard computer desk. When finished using the desk the user would simply fold the desk and wheel it to the desired storage location.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foldable computer desk for supporting a computer system, the foldable computer desk comprising:

a plurality of shelves being coupled to at least one of a pair of stanchion members, each of said shelves being hingably coupled to at least one of said stanchion members for facilitating folding of said shelves into a storage position, each of said shelves being adapted for supporting objects when said shelves are in an extended position;

each of said stanchion members having a slide rail, a sliding shelf being slidably coupled to said slide rail of each of said stanchion members such that said sliding shelf is slidably adjustable with respect to said stanchion members of a frame assembly, said sliding shelf being adapted for supporting a keyboard of the computer system, said sliding shelf being removable from between said stanchion members when said shelves are folded into said storage positions;

said shelves comprising a pair of component shelves, each of said component shelves being coupled between said stanchion members, each of said component shelves being adapted for supporting a component of the computer system; and each of said component shelves having a first portion and a second portion, said first portion of each of said component being hingably coupled to one of said stanchion members, said second portion of each of said component shelves being hingably coupled to one of said stanchion members opposite said first portion an associated one of said component shelves, said first portion of one of said component shelves being hingably coupled to said second portion of the associated one of said component shelves for permitting said component shelves to fold when said shelves are folded into a storage position.

2. The foldable computer desk as set forth in claim 1, further comprising:

each of said component shelves having bracing arm, said bracing arm of each of said component shelves being pivotally coupled to said second portion of said component shelves, said bracing arm being positionable under said first portion and an associated said second portion of said component shelves for securing each of said component shelves in an extended position.

3. The foldable computer desk as set forth in claim 1, further comprising:

said plurality of shelves comprising at least one top shelf, said top shelf being hingably coupled proximate a top end of one of said stanchion members, said top shelf being adapted for supporting objects when said shelves are in said extended position.

4. The foldable computer desk as set forth in claim 3, further comprising:

a top bracket member having a first arm and a second arm, said first arm of said top bracket member being rotatably coupled to said top shelf, said second arm of said top bracket member being rotatably coupled to said stanchion adjacent said top shelf, said first arm of said top bracket member being rotatably coupled to said second arm of said top bracket member for permitting said top bracket member to fold when said shelves are in said storage position, said top bracket member being for supporting said top shelf when said shelves are in said extended position.

5. The foldable computer desk as set forth in claim 3, further comprising:

a storage bin being coupled to a bottom surface of said top shelf, said bin being collapsible when said shelves are folded into said storage position, said storage bin being adapted for storing objects under said top shelf.

6. The foldable computer desk as set forth in claim 1, further comprising:

said plurality of shelves comprising a pair of medial shelves, each of said medial shelves being hingably coupled proximate a medial portion of one of said stanchion members, each of said medial shelves being adapted for supporting objects when said shelves are in said extended position.

7. The foldable computer desk as set forth in claim 6, further comprising:

a plurality of medial bracket members each having a first arm and a second arm, each of said medial bracket members being coupled to one of said medial shelves, said first arm of one of said medial bracket members being rotatably coupled to one of said medial shelves, said second arm of one of said medial bracket members being rotatably coupled to said stanchion adjacent an associated one of said medial shelves, said first arm of said medial bracket member being rotatably coupled to an associated said second arm of one of said medial bracket members of the associated one of said medial shelves for permitting said medial bracket members to fold when said shelves are in said storage position, said medial bracket members being for supporting the associated one of said medial shelves when said shelves are in said extended position.

8. The foldable computer desk as set forth in claim 1, further comprising:

said plurality of shelves comprising a pair of bottom shelves, each of said bottom shelves being hingably coupled proximate a bottom end of one of said stanchion members, each of said bottom shelves being adapted for supporting objects when said shelves are in said extended position.

9. The foldable computer desk as set forth in claim 8, further comprising:

a plurality of bottom bracket members each having a first arm and a second arm, each of said bottom bracket members being coupled to one of said bottom shelves, said first arm of one of said bottom bracket members being rotatably coupled to one of said bottom shelves, said second arm of one of said bottom bracket members being rotatably coupled to said stanchion adjacent an associated one of said bottom shelves, said first arm of said bottom bracket member being rotatably coupled to an associated said second arm of one of said bottom bracket members of the associated one of said bottom shelves for permitting said bottom bracket members to fold when said shelves are in said storage position, said bottom bracket members being for supporting the associated one of said bottom shelves when said shelves are in said extended position.

10. The foldable computer desk as set forth in claim 8, further comprising:

each of said bottom shelves having a base portion and an extension portion, said base portion of each of said bottom shelves being hingably coupled to one of said stanchions, said extension portion of each of said bottom shelves being slidably coupled to said base portion of an associated one of said bottom shelves such that said extension portion is extended from said base portion of the associated one of said bottom shelves when said bottom shelves are supporting a wide object.

11. The foldable computer desk as set forth in claim 10, further comprising:

said extension portion of each of said bottom shelves having a plurality of rods, each of said rods being slidably received by said base portion of the associated one of said bottom shelves for facilitating adjustment of said extension portion with respect to said base portion of the associated one of said bottom shelves.

12. The foldable computer desk as set forth in claim 8, further comprising:

a bag member being coupled to a lower surface of one of said bottom shelves, said bag member being adapted for holding tools within said bag member.

13. The foldable computer desk as set forth in claim 1, further comprising:

a bracing member extended between said stanchion members, said bracing member being for securing said stanchion members when said shelves are in an extended position.

14. The foldable computer desk as set forth in claim 13, further comprising:

said bracing member having a first bracing portion and second bracing portion, said first bracing portion being hingably coupled to one of said stanchion members, said second bracing portion being hingably coupled to one of said stanchion members opposites said first bracing portion, said first bracing portion being hingably coupled to said second bracing member for facilitating folding of said bracing member when said shelves are folded into said storage position.

15. The foldable computer desk as set forth in claim 1, further comprising:

a plurality of speakers each being coupled to one of said stanchion members, each of said speakers being adapted for operationally coupling to the computer system for producing sound generated by the computer system.

16. The foldable computer desk as set forth in claim 1, further comprising:

a light assembly being coupled to one of said component shelves, said light assembly being adapted for emitting light onto objects being supported on another of said shelves when the user requires additional light.

17. The foldable computer desk as set forth in claim 1, further comprising:

at least one media storage device being coupled to one of said stanchion members, said media storage device being adapted for storing media when the media is not being used by the user.

18. A foldable computer desk for supporting a computer system, the foldable computer desk comprising:

a plurality of shelves being coupled to at least one of a pair of stanchion members, each of said shelves being hingably coupled to at least one of said stanchion members for facilitating folding of said shelves into a storage position, each of said shelves being adapted for supporting objects when said shelves are in an extended position;

each of said stanchion members having a slide rail, a sliding shelf being slidably coupled to said slide rail of each of said stanchion members such that said sliding shelf is slidably adjustable with respect to said stanchion members of said frame assembly, said sliding shelf being adapted for supporting a keyboard of the computer system, said sliding shelf being removable from between said stanchion members when said shelves are folded into said storage position;

wherein said shelves comprising a pair of component shelves, each of said component shelves being coupled between said stanchion members, each of said component shelves being adapted for supporting a component of the computer system;

wherein each of said component shelves having a first portion and a second portion, said first portion of each of said component being hingably coupled to one of said stanchion members, said second portion of each of said component shelves being hingably coupled to one of said stanchion members opposite said first portion an associated one of said component shelves, said first portion of one of said component shelves being hingably coupled to said second portion of the associated one of said component shelves for permitting said component shelves to fold when said shelves are folded into a storage position;

wherein each of said component shelves having bracing arm, said bracing arm of each of said component shelves being pivotally coupled to said second portion of said component shelves, said bracing arm being positionable under said first portion and an associated said second portion of said component shelves for securing each of said component shelves in an extended position;

wherein said plurality of shelves comprising at least one top shelf, said top shelf being hingably coupled proximate a top end of one of said stanchion members, said top shelf being adapted for supporting objects when said shelves are in said extended position;

wherein a top bracket member having a first arm and a second arm, said first arm of said top bracket member being rotatably coupled to said top shelf, said second arm of said top bracket member being rotatably coupled to said stanchion adjacent said top shelf, said first arm of said top bracket member being rotatably coupled to said second arm of said top bracket member for permitting said top bracket member to fold when said shelves are in said storage position, said top bracket member being for supporting said top shelf when said shelves are in said extended position;

wherein said plurality of shelves comprising a pair of medial shelves, each of said medial shelves being hingably coupled proximate a medial portion of one of said stanchion members, each of said medial shelves being adapted for supporting objects when said shelves are in said extended position;

wherein a plurality of medial bracket members each having a first arm and a second arm, each of said medial bracket members being coupled to one of said medial shelves, said first arm of one of said medial bracket members being rotatably coupled to one of said medial shelves, said second arm of one of said medial bracket members being rotatably coupled to said stanchion adjacent an associated one of said medial shelves, said first arm of said medial bracket member being rotatably coupled to an associated said second arm of one of said medial bracket members of the associated one of said medial shelves for permitting said medial bracket members to fold when said shelves are in said storage position, said medial bracket members being for supporting the associated one of said medial shelves when said shelves are in said extended position;

wherein said plurality of shelves comprising a pair of bottom shelves, each of said bottom shelves being hingably coupled proximate a bottom end of one of said stanchion members, each of said bottom shelves being adapted for supporting objects when said shelves are in said extended position;

wherein a plurality of bottom bracket members each having a first arm and a second arm, each of said bottom bracket members being coupled to one of said bottom shelves, said first arm of one of said bottom bracket members being rotatably coupled to one of said bottom shelves, said second arm of one of said bottom bracket members being rotatably coupled to said stanchion adjacent an associated one of said bottom shelves, said first arm of said bottom bracket member being rotatably coupled to an associated said second arm of one of said bottom bracket members of the associated one of said bottom shelves for permitting said bottom bracket members to fold when said shelves are in said storage position, said bottom bracket members being for supporting the associated one of said bottom shelves when said shelves are in said extended position;

wherein each of said bottom shelves having a base portion and an extension portion, said base portion of each of said bottom shelves being hingably coupled to one of said stanchions, said extension portion of each of said bottom shelves being slidably coupled to said base portion of an associated one of said bottom shelves such that said extension portion is extended from said base portion of the associated one of said bottom shelves when said bottom shelves are supporting a wide object;

wherein said extension portion of each of said bottom shelves having a plurality of rods, each of said rods being slidably received by said base portion of the associated one of said bottom shelves for facilitating adjustment of said extension portion with respect to said base portion of the associated one of said bottom shelves;

wherein a bracing member extended between said stanchion members, said bracing member being for securing said stanchion members when said shelves are in an extended position;

wherein said bracing member having a first bracing portion and second bracing portion, said first bracing portion being hingably coupled to one of said stanchion members, said second bracing portion being hingably coupled to one of said stanchion members opposites said first bracing portion, said first bracing portion being hingably coupled to said second bracing member for facilitating folding of said bracing member when said shelves are folded into said storage position;

wherein a storage bin being coupled to a bottom surface of said top shelf, said bin being collapsible when said shelves are folded into said storage position, said storage bin being adapted for storing objects under said top shelf;

wherein a bag member being coupled to a lower surface of one of said bottom shelves, said bag member being adapted for holding tools within said bag member;

wherein a plurality of speakers each being coupled to one of said stanchion members, each of said speakers being adapted for operationally coupling to the computer system for producing sound generated by the computer system;

wherein a light assembly being coupled to one of said component shelves, said light assembly being adapted for emitting light onto objects being supported on another of said shelves when the user requires additional light; and wherein at least one media storage device being coupled to one of said stanchion members, said media storage device being adapted for storing media when the media is not being used by the user.

19. A foldable computer desk for supporting a computer system, the foldable computer desk comprising:

a plurality of shelves being coupled to at least one of a pair of stanchion members, each of said shelves being hingably coupled to at least one of said stanchion members for facilitating folding of said shelves into a storage position, each of said shelves being adapted for supporting objects when said shelves are in an extended position;

each of said stanchion members having a slide rail, a sliding shelf being slidably coupled to said slide rail of each of said stanchion members such that said sliding shelf is slidably adjustable with respect to said stanchion members of a frame assembly, said sliding shelf being adapted for supporting a keyboard of the computer system, said sliding shelf being removable from between said stanchion members when said shelves are folded into said storage position;

said plurality of shelves comprising at least one top shelf, said top shelf being hingably coupled proximate a top end of one of said stanchion members, said top shelf being adapted for supporting objects when said shelves are in said extended position; and a top bracket member having a first arm and a second arm, said first arm of said top bracket member being rotatably coupled to said top shelf, said second arm of said top bracket member being rotatably coupled to said stanchion adjacent said top shelf, said first arm of said top bracket member being rotatably coupled to said second arm of said top bracket member for permitting said top bracket member to fold when said shelves are in said storage position, said top bracket member being for supporting said top shelf when said shelves are in said extended position.

* * * * *